US007048843B2

(12) United States Patent
Olbrich et al.

(10) Patent No.: US 7,048,843 B2
(45) Date of Patent: May 23, 2006

(54) METHOD FOR PRODUCING METAL HYDROXIDES OR ALKALINE METAL CARBONATES

(75) Inventors: Armin Olbrich, Seesen (DE); Astrid Görge, Goslar (DE); Frank Schrumpf, Goslar (DE); Juliane Meese-Marktscheffel, Goslar (DE); Viktor Stoller, Bad Harzburg (DE); Gerhard Gille, Goslar (DE); Josef Schmoll, Goslar (DE); Michael Kruft, Goslar (DE); Dirk Naumann, Mississauga (CA)

(73) Assignee: H.C. Starck GmbH, Goslar (DE)

( * ) Notice: Subject to any disclaimer, the term of this patent is extended or adjusted under 35 U.S.C. 154(b) by 558 days.

(21) Appl. No.: 10/311,396

(22) PCT Filed: Jun. 6, 2001

(86) PCT No.: PCT/EP01/06420

§ 371 (c)(1),
(2), (4) Date: Dec. 13, 2002

(87) PCT Pub. No.: WO01/98559

PCT Pub. Date: Dec. 27, 2001

(65) Prior Publication Data

US 2003/0141199 A1 Jul. 31, 2003

(30) Foreign Application Priority Data

Jun. 19, 2000 (DE) ..... 100 30 093

(51) Int. Cl.
*C25B 1/00* (2006.01)
*C25B 1/16* (2006.01)

(52) U.S. Cl. ..... 205/508; 205/508; 205/509; 205/514

(58) Field of Classification Search ..... 205/344, 205/508, 509, 60; 423/419.1, 421, 594.3, 423/594.4
See application file for complete search history.

(56) References Cited

U.S. PATENT DOCUMENTS 4,080,270 A * 3/1978 O'Leary et al. ..... 205/482

(Continued)

FOREIGN PATENT DOCUMENTS

CA 2149857 11/1995

OTHER PUBLICATIONS

Database WPI Section CH, Week 198215 Derwent Publications Ltd., London, GB; An 1982-30405E XP0021.79653 & SU 834 253 A (Ivan Chem-Techn), 30, Mai 1981 (May 30, 1981).

*Primary Examiner*—Nam Nguyen
*Assistant Examiner*—Luan V. Van
(74) *Attorney, Agent, or Firm*—Joseph C. Gil

(57) ABSTRACT

The invention relates to a method for producing metal hydroxides or alkaline metal carbonates by anode dissolution of the corresponding metals and precipitation of the hydroxides or alkaline carbonates in an aqueous medium. The anode dissolution of the metal components is carried out in the anode compartment of a three-compartment electrolytic cell. An aqueous auxiliary salt solution is fed to an intermediate compartment that is disposed between the anode compartment and the cathode compartment and that is separated therefrom by a porous membrane. An at least not alkaline metal salt solution is continuously taken from the anode compartment while an alkaline auxiliary salt solution is continuously taken from the cathode compartment. The at least not alkaline metal salt solution and the alkaline auxiliary salt solution are combined outside the electrolytic cell for the purpose of precipitating metal hydroxides or alkaline metal carbonates.

16 Claims, 1 Drawing Sheet

Figure 1:
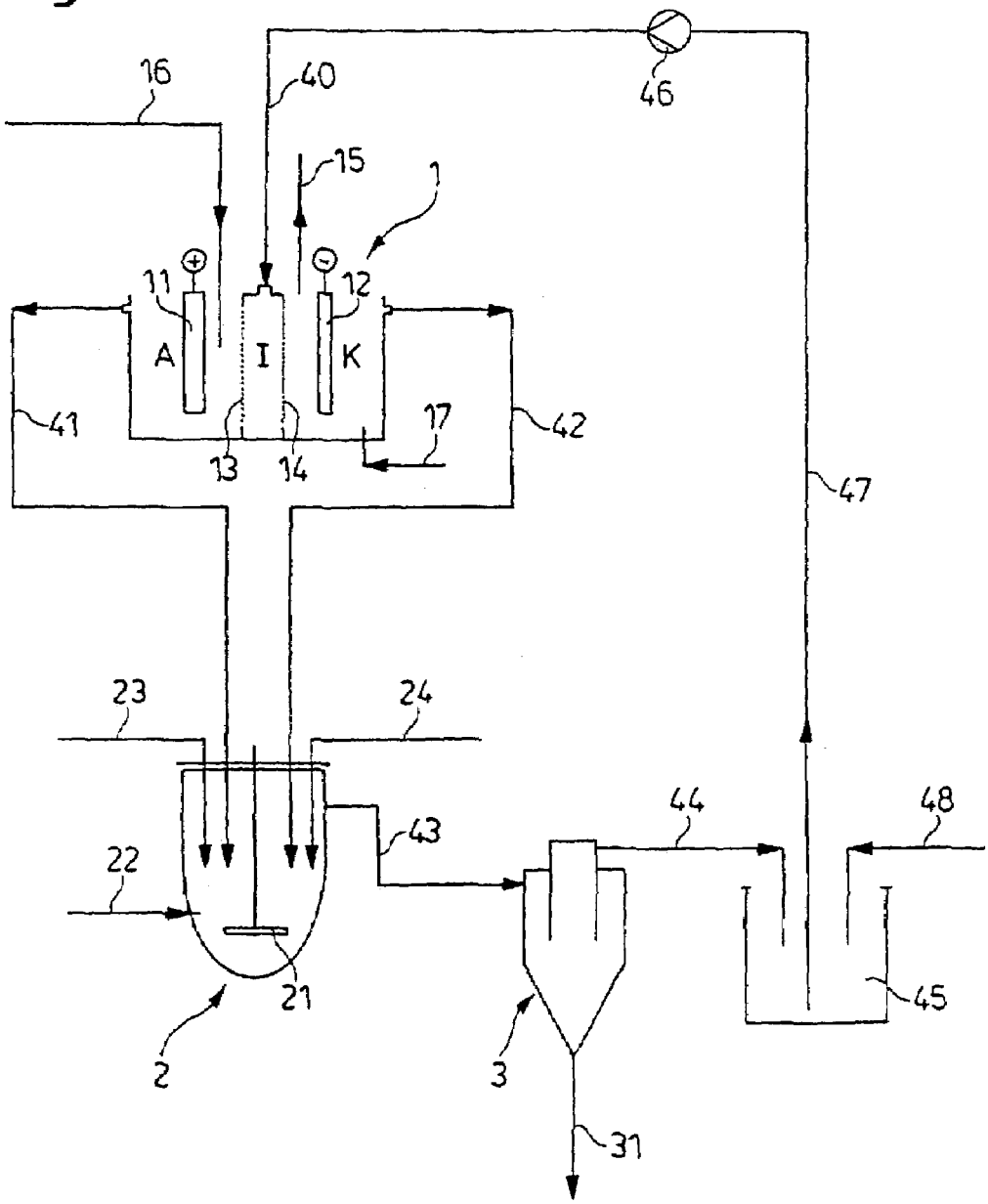

U.S. PATENT DOCUMENTS 4,265,718 A * 5/1981 Limare et al. ..... 205/509
5,389,211 A * 2/1995 Sharifian et al. ..... 205/455
5,660,709 A * 8/1997 Bauer et al. ..... 205/344
5,716,512 A * 2/1998 Vaughan ..... 205/488

* cited by examiner

METHOD FOR PRODUCING METAL HYDROXIDES OR ALKALINE METAL CARBONATES

FIELD OF THE INVENTION

The present invention relates to a process for the preparation of metal hydroxides and/or metal carbonates by anodic dissolution of corresponding metals and precipitation of the hydroxides or basic carbonates in an aqueous medium.

BACKGROUND OF THE INVENTION

Metal hydroxides and basic metal carbonates are usually prepared by precipitation from corresponding aqueous metal salt solutions by reaction with alkali hydroxides and alkali hydrogen carbonates, respectively. In that reaction, stoichiometric amounts of neutral salts are formed, which must be worked up or disposed of.

In order to avoid the formation of neutral salts, it has therefore been proposed according to U.S. Pat. No. 5,391,265 to prepare nickel hydroxide by the production of nickel ions by anodic dissolution and hydroxyl ions by the electrolytic decomposition of water, hydrogen being formed at the cathode in addition to precipitated nickel hydroxide. In that process, the electrolytic cell is charged with a conducting salt solution (sodium chloride and sodium sulfate), the conducting salt solution being fed back into the electrolytic cell again after separation of the precipitated nickel hydroxide. Accordingly, the process takes place substantially without the formation of neutral salts. A disadvantage of that process is that the nickel hydroxide is obtained in very finely divided form as a filterable but gel-like product having high bonded water contents, which product must subsequently be conditioned. The achievable particle size can be influenced only with great difficulty.

According to EP-A 684 324 it has been proposed to circulate separate anolyte and catholyte circuits in a two-chamber electrolytic cell divided by an anionic ion-exchange membrane, wherein nickel is dissolved anodically in the anode chamber, the anolyte contains ammonia as complexing agent, hydroxyl ions are produced in the cathode chamber and conveyed through the membrane into the anode chamber, the nickel ammine complexes are hydrolysed in the anolyte by means of an increase in temperature, and nickel hydroxide is precipitated and separated from the anolyte. The process allows the particle size of the nickel hydroxide to be controlled within wide ranges by controlling the hydrolysis process. However, the process is cost-intensive and susceptible to failure owing to the still inadequate useful life of commercially available membranes.

The object of the invention is to provide a process for the preparation of metal hydroxides that does not have the mentioned disadvantages. The process according to the invention also permits the preparation of basic metal carbonates substantially without the formation of neutral salts.

It has now been found that metal hydroxides or basic metal carbonates can be prepared in a two-step process, as follows: in a first step, a metal salt solution is obtained, using an alkali salt solution, by anodic dissolution of the metal, and an alkaline alkali salt solution is obtained by cathodic evolution of hydrogen, which solutions are combined in a second step in order to precipitate the metal hydroxide. The alkali metal salt solution obtained after separation of the metal hydroxide precipitation product is fed back into the electrolytic cell. That is made possible by the use of a three-chamber electrolytic cell in which the chambers are separated by porous membranes, by introducing an alkali salt solution into the intermediate chamber between the cathode chamber and the anode chamber. Basic carbonates are obtained by additionally introducing carbon dioxide into the cathode chamber or into the precipitation reactor of the second step.

Accordingly, the present invention provides a process for the preparation of metal hydroxides or basic metal carbonates by anodic dissolution of corresponding metals and precipitation of the hydroxides or basic carbonates in an aqueous medium, which process is characterised in that the anodic dissolution of the metal component takes place in the anode chamber of a three-chamber electrolytic cell, an aqueous auxiliary salt solution is fed continuously to the intermediate chamber arranged between the anode chamber and the cathode chamber and separated therefrom by porous membranes, an at least non-alkaline metal salt solution is removed continuously from the anode chamber, an alkaline auxiliary salt solution is removed continuously from the cathode chamber, and the at least non-alkaline metal salt solution and the alkaline auxiliary salt solution are combined outside the electrolytic cell in order to precipitate metal hydroxides or basic metal carbonates.

During the precipitation from the combined solutions there may optionally be supplied an alkali hydroxide solution for adjusting the desired precipitation pH value and a solution containing a complexing agent, for example an $NH_3$ solution, for producing spherical precipitated products.

Basic metal carbonates are obtained in a simple manner by introducing carbon dioxide either into the cathode chamber or into the combined precipitation solution.

Suitable metals are those which form soluble salts in an aqueous medium, can be precipitated in a neutral or alkaline medium in the form of hydroxides and/or basic carbonates and which, when connected as the anode in the electrolytic cell, do not form non-conductive surface layers (oxides). The metals particularly preferably used are Fe, Co, Ni, Cu, In, Mn, Sn, Zn, Cd and/or Al. Nickel or cobalt anodes are preferably used.

Suitable auxiliary salts for introduction into the intermediate chamber of the electrolytic cell are chlorides, nitrates, sulfates, acetates and/or formates of alkali and/or alkaline earth metals. Sodium chloride and sodium sulfate are preferred. The auxiliary salt solution preferably has a concentration of from 1 to 3 mol/l.

The auxiliary salt solution introduced into the intermediate chamber flows through the porous membranes to the anode chamber and to the cathode chamber, whereupon, as a result of the effect of the electric field, partial ion separation of the auxiliary salt solution takes place into a component having excess anions, which flows to the anode, and a component having excess cations, which flows to the cathode. The auxiliary salt solution is preferably introduced into the intermediate chamber under a pressure such that the rate of flow through the porous membranes is greater than the migration rate of the anodically produced metal ions and the cathodically produced $OH^-$ ions in their respective solutions, so that the anodically produced metal ions and the cathodically produced $OH^-$ ions cannot pass into the intermediate chamber. On the other hand, the separation of the auxiliary salt solution into components having excess anions and excess cations is better, that is to say the transfer of neutral auxiliary salt into the anode and cathode chambers is lower, the lower the rate of flow of the auxiliary salt solution through the membranes. Optimum conditions can be determined by means of simple preliminary tests in dependence on the structural properties of the separation medium or its permeability or flow resistance. With regard to the separation effect and the electrical energy to be applied, it is possible to establish an optimum that is determined by the nature and concentration of the electrolyte. The rate of influx of the electrolyte must be so chosen that the ions having the higher mobility are at all events prevented from passing into the middle chamber. Preferably, the ratio of anions to cations in the auxiliary salt solution that passes through the membrane to the anode side is approximately 1.5 to 3 and, conversely, the ratio of cations to anions in the auxiliary salt solution that passes through the membrane to the cathode chamber is approximately 1.2 to 3.

The whole of the auxiliary salt solution introduced into the intermediate chamber preferably passes through the porous membranes.

Suitable membranes are porous, preferably woven, cloths or nets consisting of materials that are resistant to the auxiliary salt solutions, the anolytes and the catholytes. For example, polypropylene cloths such as are supplied by SCAPA FILTRATION GmbH under the name Propex may be used. Suitable cloths preferably have a pore radius of from 10 to 30 μm. The porosity may be from 20 to 50%.

The auxiliary salt solution having excess anions that passes into the anode space from the middle chamber is substantially neutralised by the anodic dissolution of the metal anode and continuously drawn off as anolyte. In order to avoid the formation of precipitated products in the anode chamber solution (anolyte), a small amount of acid may be fed into the anode chamber, preferably by feeding in an acid that contains the anion of the auxiliary salt solution. The anolyte discharged from the anode chamber preferably has a metal salt content of from 0.5 to 2 mol/l. At the cathode, hydrogen and $OH^-$ ions are formed according to the excess of cations in the auxiliary salt that have passed through the membrane to the cathode space. An alkaline auxiliary salt solution (catholyte) therefore flows over from the cathode chamber.

The anolyte and catholyte are subsequently subjected to a precipitation reaction in a precipitation reactor. A hydroxide solution may optionally be added in order to adjust the precipitation pH value, and complexing agents such as ammonia may optionally be added in order to achieve a spherical form of the precipitated products. For the preparation of basic carbonates, carbon dioxide is introduced into the catholyte or directly into the precipitation reactor. After separation of the precipitated product, an optionally alkaline auxiliary salt solution remains which, after being neutralised, is preferably fed back into the intermediate chamber of the electrolysis. It is also possible to store the anolyte and catholyte in intermediate containers and to carry out the precipitation discontinuously.

For the preparation of doped metal hydroxides, corresponding metal salt solutions of salts of the doping metals may be introduced into the precipitation reactor, in which case the amount of alkali hydroxide fed to the precipitation reactor for adjusting the precipitation pH value increases in a molar manner according to the amount of doping salts. A corresponding excess amount of neutral salts is therefore formed, which cannot be fed back into the intermediate chamber of the electrolytic cell.

Accordingly, for the preparation of mixed metal hydroxides it is advantageous either to use anodes that are alloyed according to the composition of the mixed metal hydroxide, or to provide in the anode chamber a plurality of anodes of the alloy metals, those anodes being subjected to electrolysis stream intensities the ratio of which corresponds to the (equivalent) ratio of the metals of the mixed metal hydroxide composition or, alternatively, to prepare the respective metal salt components separately in separate three-chamber electrolytic cells.

The precipitation reaction may also be controlled by the presence of complexing agents, for example ammonia, in the precipitation reactor. For example, in the preparation of nickel hydroxide, spherical nickel hydroxides are obtained by introducing ammonioma into the precipitation reactor.

Amphoteric doping metals, such as, for example, aluminium, may be introduced into the catholyte in the form of the aluminium salt or aluminates.

Following the precipitation, the precipitated product is separated from the combined auxiliary salt solution (mother liquor). That may be effected by sedimentation, by means of cyclones, by centrifugation or filtration. The separation may be carried out stepwise, the precipitated product being obtained in fractionated form according to particle size. It may also be advantageous to feed a portion of the mother liquor containing the small metal hydroxide particles as crystal nuclei back into the precipitation reactor once the large metal hydroxide particles have been separated off.

The mother liquor freed of the precipitated product, optionally after being worked up, is fed back into the intermediate chamber of the three-chamber electrolytic cell.

Working up serves to remove residual metal ions, to prevent impurities from becoming concentrated, and to re-adjust the concentration and composition of the auxiliary salt solution, for example to strip any complexing agent optionally introduced for precipitation purposes. Working up of the mother liquor may take place in a split stream.

On the other hand, the process is insensitive as regards working up of the auxiliary salt solution. Accordingly, it is generally harmless if the complexing agent is fed back into the intermediate chamber with the mother liquor. Likewise, the process is scarcely impaired by the introduction of small amounts of metal ions into the intermediate chamber. The metal ions are precipitated in the intermediate chamber or in the catholyte as hydroxide slurry that may settle out, or are discharged into the precipitation reactor with the catholyte as very finely divided hydroxide.

With the process according to the invention there is made available an extremely flexible electrolytic process for the preparation of metal hydroxides, in which substantially no further materials are required other than the materials of the anode metal and water as well as small amounts of acids and/or bases for regulating the pH value, and accordingly no secondary products are formed either. The flexibility is the result of the electrolytic separation of a recirculable, neutral auxiliary salt solution into an acid and an alkaline component as it passes through robust, porous, electrochemically inactive membranes. It is thus possible to discharge the metal ions and the hydroxide ions from the electrolytic cell in the form of separate solutions and combine them again only for the purposes of precipitation. As a result, the precipitation itself can be controlled independently without affecting or being affected by the electrolysis process.

Accordingly, with the process according to the invention there is made available an extremely flexible process for the preparation of metal hydroxides or basic carbonates.

The person skilled in the art is readily capable of carrying out further variations adapted to the particular requirements for the preparation of a specific product. For example, it is possible, accepting slightly higher pressures in the intermediate chamber, to render the conducting salt anion/cation ratio that passes to the anolyte or catholyte more advantageous, by using multi-layer filter cloths. It is also possible to separate the middle chamber on the cathode side and on the anode side by different separation media (filter cloths, diaphragms, etc.) in order to permit different flow conditions (rates) into the cathode space and the anode space. Furthermore, while maintaining the three-chamber principle, that is to say the separation of the anode space and the cathode space by a middle chamber, arrangements of the electrodes and separation media that are completely different in terms of geometry are possible. For example, the electrodes may be arranged concentrically as in a tubular condenser. In the middle of a cylindrical cell there is a cylindrical electrode, the counter electrode is arranged concentrically to that central electrode as a tube. In the tubular space between the two electrodes is the middle chamber, which is likewise arranged concentrically and which is formed by two tubular filter cloths, diaphragms or similar separation media extending parallel to each other.

The invention also provides a device for the preparation of metal hydroxides, containing a three-chamber electrolytic cell, a precipitation reactor and means of separating solids from the product discharged from the precipitation reactor, the electrolytic cell being divided by means of porous membranes into an anode chamber, an intermediate chamber and a cathode chamber, having an inlet to the intermediate chamber, an outlet from the anode chamber and an outlet from the cathode chamber, an inlet of the precipitation reactor being connected to the outlet from the anode chamber, and a further inlet of the precipitation chamber being connected to the outlet from the cathode chamber.

The cathode chamber also has an outlet for cathodically produced hydrogen. There may also be provided means of introducing subordinate amounts of auxiliary reagents such as acid into the anode chamber, base into the precipitation reactor, both acid and base for adjusting the pH value, as well as complexing agents and doping agents into the precipitation reactor.

The invention is explained in greater detail with reference to the attached FIG. 1:

FIG. 1 shows diagrammatically the three-chamber electrolytic cell 1, the precipitation reactor 2 and the separating device 3 for the precipitated product. The electrolytic cell 1 is divided by means of the porous membranes 13 and 14 into the anode chamber A, the intermediate chamber I and the cathode chamber K. In the anode chamber there is the anode 11, which consists of the metal that is to be dissolved anodically; in the cathode chamber there is the cathode K, which is resistant to the alkaline auxiliary salt solution. A neutral auxiliary salt solution is introduced into the intermediate chamber I via pipe 40 by means of a mass-flow-regulated pump 46. A constant current with current densities of from 300 to 1200 $A/m^2$ flows between the anode A and the cathode K. A substantially neutral or weakly acid solution containing auxiliary salt and anode metal salt flows over from the anode chamber A vie pipe 41. An alkaline auxiliary salt solution passes from the cathode chamber via pipe 42. Hydrogen is discharged from the head of the cathode chamber via pipe 15.

In order to adjust a particular pH value, acid may be fed into the anode chamber via pipe 16.

Furthermore, carbon dioxide may be introduced via pipe 17 in order to prepare basic metal carbonates.

The products 41 and 42 discharged from the electrolytic cell 1 are fed into the precipitation reactor 2. The precipitation reactor contains, for example, a high-speed stirrer 21. The precipitation reactor may also be in the form of a loop-type or propulsive-jet reactor or in a different form. The precipitated suspension flows over from the precipitation reactor in pipe 43. It is also possible to provide inlet devices 22, 23 and 24 for the introduction of auxiliary and modifying agents, such as for adjusting the pH value, doping and/or influencing the precipitation by introduction of complexing agents, or for the introduction of $CO_2$ for the preparation of basic carbonates. Depending on the desired precipitation conditions, the precipitation reactor 2 may also be in the form of a reactor cascade, partial streams of the products 41 or 42 discharged from the electrolytic cell being introduced into the individual reactors of the cascade.

The precipitated suspension passes via pipe 43 into the separating device 3, which in this case is shown as a hydro-cyclone, from which the precipitated solid is largely drawn off via the bottom outlet 31 and the precipitation mother liquor freed of solid flows over via pipe 44 to the means for working up 45. Arrow 48 shows diagrammatically the introduction of working-up reagents and the removal of interfering components that may be present. The worked-up mother liquor can be fed back into the intermediate chamber I via pipe 47 and pump 46.

EXAMPLE 1

An electrolytic cell as is shown diagrammatically in FIG. 1 was used. The anode area and the cathode area were each 7.5 $dm^2$. The distance between the electrodes was 4 cm. The porous membranes used were polypropylene cloths having a mean pore diameter of 26 μm and a porosity, calculated from the density determination of the cloth, of 28%, such as are obtainable from Scapa Filtration GmbH (Propex E14K). The anode was of high-purity nickel. A nickel electrode was also used as the cathode. 8.18 l per hour of sodium chloride solution containing 80 g/l of sodium chloride were fed to the intermediate chamber of the cell. 25 ml per hour of a 1-normal hydrochloric acid solution were also introduced into the anode space.

The anodic current intensity was 1000 $A/m^2$. A voltage of 7.3 V was measured between the anode and the cathode. Once the steady-state condition had been reached, 3.67 l of anolyte flowed from the anode chamber and 4.53 l of catholyte flowed from the cathode chamber per hour.

The anolyte and catholyte were passed continuously into a stirred precipitation reactor, into which there were additionally introduced, per hour, 184 ml of ammonia solution containing 220 g/l of $NH_3$, and 107 ml/h of sodium hydroxide solution containing 200 g/l of NaOH, and 71.4 ml of a doping solution containing 20 g/l of cobalt and 100 g/l of zinc in the form of their chloride salts.

142.9 g of nickel hydroxide doped with 1% cobalt and 5% zinc were removed from the overflow of the precipitation container per hour.

The alkaline mother liquor was passed into a stripping column for removal of the ammonia, then neutralised and fed back into the storage container from which the auxiliary salt solution is taken.

A spherical nickel hydroxide having a mean particle diameter of 12 μm, which is extremely suitable for use as the positive electrode material for rechargeable batteries was obtained. The electrochemical mass utilisation in standard half-cell tests was at least 100%.

EXAMPLE 2

Example 1 was repeated, with the difference that an auxiliary salt solution containing 4.5 g/l of $NH_3$ in addition to 80 g/l of NaCl was used. The introduction of ammonia solution into the precipitation reactor was dispensed with.

EXAMPLE 3

Example 2 was repeated, with the difference that cobalt and zinc electrodes were additionally provided in the anode chamber and were subjected to current intensities corresponding to the desired molar ratio of Co and Zn in the nickel hydroxide. Working up of the mother liquor from the precipitation reactor consisted only in adding water that had been consumed.

The product yielded the following analytical data:

| | |
|---|---|
| Ni | 57.47 wt. % |
| Zn | 1 wt. % |
| Co | 5 wt. % |
| $H_2O$ | 1.2 wt. % (dry loss 2 h 150° C.) |
| Na | 200 ppm |
| Cl | 400 ppm |
| $NH_3$ | 120 ppm |
| Half-width of the 101 X-ray reflex: | 0.98° 2 Θ |
| Mean particle diameter ($D_{50}$ Mastersizer): | 8.9 μm |
| Specific surface area (BET with Quantasorb): | 10.8 $m^2/g$. |

EXAMPLE 4

5.66 l/h of an 8% sodium chloride solution are fed into the intermediate chamber of the electrolytic cell according to Example 1. At the same time, 119.5 g of $CO_2$/h in gaseous form are introduced into the cathode space via a glass frit. The anodic current intensity is 72.8 A. Once the steady-state condition has been reached, 2.66 l/h of acolyte having a cobalt concentration of 30.1 g/l are discharged from the anode space, and 3.03 l/h of catholyte having a sodium hydrogen carbonate concentration of 75.4 g/l are discharged from the cathode space. The two discharged products are combined in the precipitation reactor with vigorous stirring at a temperature of 80° C. 5.55 l/h of a suspension having a solids content of 26.3 g/l are discharged continuously from the reactor. The suspension is collected over a period of 5 hours and then filtered over a suction filter. Washing with 2.2 l of water and drying in a drying cabinet at 80° C. yield a basic cobalt carbonate having a cobalt content of 54.8 wt. % and a $CO_3$ content of 23.5 wt. %. The product has spherical morphology and can be converted, while retaining the morphology, into spherical cobalt metal powder having excellent hot-press behaviour.

The invention claimed is:

1. A process for the preparation of metal hydroxides or basic metal carbonates by anodic dissolution of corresponding metals and precipitation of the hydroxides or basic carbonates in an aqueous medium, said process comprising:

(a) providing a three-chamber electrolytic cell comprising an anode chamber, a cathode chamber and an intermediate chamber interposed between said anode chamber and said cathode chamber, said intermediate chamber being separated from each of said anode chamber and said cathode chamber by a porous membrane, said anode chamber having an outlet and an anode fabricated from at least one metal that is to be anodically dissoluted, said intermediate chamber having an inlet, and said cathode chamber having an outlet;

(b) providing a precipitation reactor that is in fluid communication with said outlet of said anode chamber and said outlet of said cathode chamber, said precipitation reactor being separate from said three-chamber electrolytic cell and not being an electrolytic cell;

(c) performing the anodic dissolution of the metals in said anode chamber of said three-chamber electrolytic cell;

(d) feeding an aqueous auxiliary salt solution continuously into said intermediate chamber by means of said inlet of said intermediate chamber, wherein said aqueous salt solution consists of water and an auxiliary salt selected from the group consisting of alkali metal chlorides, alkaline earth metal chlorides, alkali metal nitrates, alkaline earth metal nitrates, alkali metal sulfates, alkaline earth metal sulfates, alkali metal acetates, alkaline earth metal acetates, alkali metal formates, alkaline earth metal formates and combinations thereof;

(e) removing an at least non-alkaline metal salt solution continuously from the outlet of said anode chamber, (f) removing an alkaline auxiliary salt solution continuously from the outlet of said cathode chamber, and (g) combining, the at least non-alkaline metal salt solution removed from said outlet of said anode chamber, and the alkaline auxiliary salt solution removed from said cathode chamber, in said precipitation reactor, thereby forming precipitated metal hydroxides or basic metal carbonates and a precipitation solution.

2. The process of claim 1, wherein during the combining of the at least non-alkaline metal salt solution and the alkaline auxiliary salt solution, an alkali hydroxide solution is additionally supplied for the purposes of adjusting the required precipitation pH value.

3. The process of claim 1, wherein the precipitation solution is fed back into the intermediate chamber of the electrolytic cell after precipitated metal hydroxides or alkaline metal carbonates have been separated off.

4. The process of claim 3, wherein the precipitation solution is worked up before it is fed back into the electrolytic cell.

5. The process of claim 1, wherein precipitation takes place in the presence of a complexing agent.

6. The process of claim 1, wherein precipitation takes place in the presence of ammonia.

7. The process of claim 6, wherein the ammonia is stripped from the precipitation solution after the precipitated metal hydroxides or alkaline metal carbonates have been separated off.

8. The process of claim 1, wherein said porous membrane is a porous filter cloth.

9. The process of claim 1, wherein the auxiliary salt solution is fed to the intermediate chamber under pressure effective to provide a rate of flow through the porous membrane that is not less than the mean rate of ion migration under the effect of the electric field in the auxiliary salt solution.

10. The process of claim 1, wherein the metal of the metal hydroxides or basic metal carbonates is selected from the group consisting of Fe, Co, Ni, Cu, In, Mn, Sn, Cd, Al and combinations thereof.

11. The process of claim 1, wherein the metal of the metal hydroxides or basic metal carbonates is selected from the group consisting of nickel, cobalt and combinations thereof, and said auxiliary salt is sodium chloride.

12. The process of claim 1, wherein the auxiliary salt solution introduced into the intermediate chamber has an auxiliary salt concentration of from 1.5 to 5 mol %.

13. The process of claim 1, wherein the non-alkaline metal salt solution removed from said anode chamber is an acid metal salt solution having a metal salt concentration of from 0.3 to 2 mol %.

14. The process of claim 1, further comprising introducing into the precipitation reactor doping substances for the metal hydroxide or basic metal carbonate in the form of water-soluble salt solutions.

15. The process of claim 1, further comprising introducing carbon dioxide into said cathode chamber, for the preparation of basic carbonates.

16. An apparatus for the preparation of metal hydroxides, comprising:

(a) a three-chamber electrolytic cell and being separate from said three-chamber electrolytic cell comprising an anode chamber, a cathode chamber and an intermediate chamber interposed between said anode chamber and said cathode chamber, said intermediate chamber being separated from each of said anode chamber and said cathode chamber by a porous membrane, said anode chamber having an outlet and an anode fabricated from at least one metal that is to be anodically dissoluted, said intermediate chamber having an inlet, and said cathode chamber having an outlet; and (b) a precipitation reactor comprising a first inlet that is in fluid communication with the outlet of the anode chamber, a second inlet that is in fluid communication with the outlet of the cathode chamber, an outlet, and means for separating precipitated solids from a liquid, wherein said precipitation reactor is not an electrolytic cell.

* * * * *